US010480318B2

(12) United States Patent
Lenaburg et al.

(10) Patent No.: US 10,480,318 B2
(45) Date of Patent: Nov. 19, 2019

(54) CUTTER HOUSING WITH INLINE MOUNTING

(71) Applicant: The Robbins Company, Solon, OH (US)

(72) Inventors: Carl E. Lenaburg, Tacoma, WA (US); Ross D. Galbraith, North Ogden, UT (US); Stephen M. Smading, Renton, WA (US)

(73) Assignee: The Robbins Company, Solon, OH (US)

( * ) Notice: Subject to any disclaimer, the term of this patent is extended or adjusted under 35 U.S.C. 154(b) by 79 days.

(21) Appl. No.: 15/982,856

(22) Filed: May 17, 2018

(65) Prior Publication Data

US 2018/0334906 A1 Nov. 22, 2018

Related U.S. Application Data

(60) Provisional application No. 62/508,030, filed on May 18, 2017.

(51) Int. Cl.
*E21D 9/10* (2006.01)

(52) U.S. Cl.
CPC ..... *E21D 9/104* (2013.01)

(58) Field of Classification Search
CPC ..... E21D 9/104; E21D 9/10; E21D 9/1006
See application file for complete search history.

(56) References Cited

U.S. PATENT DOCUMENTS

| | | | |
|---|---|---|---|
| 4,202,418 | A | 5/1980 | Waddell |
| 4,270,618 | A | 6/1981 | Owens |
| RE31,511 | E | 1/1984 | Spencer |
| 4,548,443 | A | 10/1985 | Turner |

(Continued)

FOREIGN PATENT DOCUMENTS

| | | | |
|---|---|---|---|
| AT | 13486 | U1 | 11/2013 |
| CA | 2785364 | A1 | 6/2011 |

(Continued)

OTHER PUBLICATIONS

International Search Report and Written Opinion dated Feb. 3, 2017, issued in corresponding Application No. PCT/US2016/059196, filed Oct. 27, 2016, 9 pages.

(Continued)

*Primary Examiner* — Kristyn A Hall
(74) *Attorney, Agent, or Firm* — Christensen O'Connor Johnson Kindness, PLLC

(57) ABSTRACT

A cutter assembly for a tunnel boring machine includes first and second housing mounts each having a plate portion, an abutment flange, and a plurality of spaced seats. A cutter ring assembly is mountable in the housings and includes two or more bridging supports that include a shaft mounting portion and two end portions that abut respective housing mount flanges. The cutter ring axis of rotation is between and parallel to the housing mounts. Separate wedge members are attachable to the housing mounts, and are configured to clamp the end portions of the bridging supports against the associated flanges. In some embodiments removable seat members are provided between the housing mount seats and the wedge members. The housing mounts and removable seats are configured to permit the cutter ring assembly to be inserted inline to the housing mounts.

20 Claims, 9 Drawing Sheets

(56) References Cited

U.S. PATENT DOCUMENTS

| | | | |
|---|---|---|---|
| 5,308,151 | A | 5/1994 | Sugden et al. |
| 5,421,422 | A | 6/1995 | Crane et al. |
| 5,598,895 | A | 2/1997 | Anderson et al. |
| 6,142,577 | A | 11/2000 | Tayama et al. |
| 9,845,677 | B2 | 12/2017 | Lenaburg et al. |
| 10,018,042 | B2 | 7/2018 | Lenaburg |
| 2013/0045055 | A1 | 2/2013 | Derycke |
| 2014/0232167 | A1 | 8/2014 | Edelmann |
| 2016/0273358 | A1 | 9/2016 | Liotard et al. |
| 2017/0122103 | A1 | 5/2017 | Barwart et al. |
| 2017/0122105 | A1 | 5/2017 | Lenaburg et al. |

FOREIGN PATENT DOCUMENTS

| | | | |
|---|---|---|---|
| DE | 10 2011 114 830 | B3 | 3/2013 |
| JP | 10-68292 | A | 3/1998 |
| JP | 11-217993 | A | 8/1999 |
| JP | 2000-17981 | A | 1/2000 |
| JP | 2007-70825 | A | 3/2007 |
| JP | 2013-127182 | A | 6/2013 |
| WO | 2015/063322 | A2 | 5/2015 |

OTHER PUBLICATIONS

International Search Report and Written Opinion dated Aug. 23, 2018, issued in corresponding Application No. PCT/US2018/033392, filed May 18, 2018, 8 pages.

CUTTER HOUSING WITH INLINE MOUNTING

CROSS-REFERENCE TO RELATED APPLICATION

This application claims the benefit of U.S. Provisional Patent Application No. 62/508,030, filed on May 18, 2017, which is hereby incorporated by reference in its entirety.

BACKGROUND

A tunnel boring machine ("TBM") is a tunnel excavation apparatus for forming tunnels in a variety of soil and rock strata. A conventional TBM produces a smooth circular tunnel wall, with minimal collateral disturbance. As discussed in U.S. Pat. No. 8,172,334, to Lindbergh et al., which is hereby incorporated by reference in its entirety, a conventional TBM typically includes a full face rotatably driven cutter head that supports a plurality of cutter assemblies. Typically, a cutter head may have 20, 50, 100, or more cutter assemblies rotatably mounted to the cutter head.

A breakthrough that made TBMs efficient and reliable was the invention of the rotating cutter head, developed by James S. Robbins. Initially, Robbins' TBM used rigid spikes rotating in a circular motion, but the spikes would frequently break. He discovered that by replacing these grinding spikes with longer lasting, rotatable cutter assemblies this problem was significantly reduced. Since then, modern TBMs include rotatable cutter assemblies.

In operation, the cutter head is urged against a surface to be bored such that at least some of the cutter assemblies forcibly engage the surface. In some TBMs a plurality of opposing sets of hydraulic cylinders engage the tunnel walls to anchor the TBM, and separate thrust cylinders press the cutter head against the rock or ground surface. The cutter head rotates about a longitudinal axis so that as the cutter assemblies are forcibly pressed against the surface they roll along the surface to fracture, loosen, grind, dislodge, and/or break materials from the surface.

As illustrated in Lindbergh et al., rotatable cutter assemblies are mounted in housings in the TBM cutter head such that the cutter ring extends forward from the face of the cutter head to engage the earthen rock wall. During operation of a TBM the cutter head is pressed with great force against the rock face, typically with hydraulic actuators, while the cutter head is rotated about its axis. The end of the cutter ring of the cutter assemblies engages the tunnel face and produces local stresses that cause the surface of the wall to fracture and crumble. The fractured and loosened material is collected and removed to gradually form the tunnel.

The cutter head and the cutter assemblies are subjected to very high forces during tunnel boring operations. Once excavation of the tunnel is started, it is very difficult to repair or replace the cutter assemblies because the assemblies are difficult to access in situ, and the cutter assemblies are heavy, often weighing many hundreds of pounds. Tunnels are often at significant depths, with correspondingly high ambient pressures. Therefore, it is critical that the installation of the cutter assembly in the cutter head be very secure and reliable, even under the extreme conditions associated with tunnel boring.

FIG. 1 herein shows an exploded view of a conventional cutter ring assembly 10 housing for a tunnel boring machine. The cutter ring assembly 10 comprises a cutter ring 15 disposed on a hub 12 that is rotatably mounted on a shaft 13 for rotation about axis 14. Bearing assemblies (not shown) are mounted generally on the shaft 13 to provide for rotation of the hub 12 and cutter ring 15 about the shaft 13.

The cutter housing assembly shown in FIG. 1 comprises spaced-apart housing mounts 20L, 20R. The rotation axis 14 for the cutter ring 15 is generally perpendicular to the housing mounts 20L, 20R. Opposite ends of the shaft 13 are secured in the housing mounts 20L, 20R in L-shaped channels 21 that are sized to receive the cutter assembly shaft 13. Typically the cutter assembly 10 is installed by positioning the opposite ends of the shaft 13 at the back of the housing mounts 20L, 20R to engage the long leg 21A of the L-shaped channels 21. The cutter assembly 10 is slid along the long leg 21A of the L-shaped channel 21 and then shifted laterally into the recess formed by the shorter leg 21B of the L-shaped channels 21. The cutter housing secures the cutter assembly 10 to the housing mounts 20L, 20R with a pair of wedge-lock assemblies 22A that engage respective ends of the shaft 13.

The wedge-lock assemblies 22A each include a wedge 22, a clamp block 24, and an optional tubular sleeve 28 disposed there between. The wedge 22 is positioned to abut an angled face on the end of the shaft 13, and the clamp block 24 engages abutment surfaces 25 on the associated housing mount 20L, 20R. A bolt 23 extends through the wedge 22, the sleeve 28, and the clamp block 24, and is secured with two nuts 26 and a washer 27. As the bolt 23 is tensioned by torquing the nuts 26 to a design specification, the wedge 22 locks the cutter assembly 10 in place.

In practice, this mounting has presented certain challenges and disadvantages. For example, the housing mounts 20L, 20R are typically hard mounted onto the TBM, for example, by welding or the like. The housing mounts are therefore challenging to remove and replace if they become damaged. If a housing mount becomes damaged, it typically must be replaced in situ, which is particularly difficult and may shut down the TBM for an extended period of time.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A cutter assembly for a tunnel boring machine includes a first housing mount and a second housing mount, that are to be fixed to the main cutter wheel of a tunnel boring machine. Each housing mount has a plate portion, an abutment flange, and a plurality of spaced-apart seats. A cutter ring assembly configured to be installed to the housing mounts includes at least two spaced-apart bridging supports, a shaft supported by the at least two bridging supports, and at least one cutter ring mounted for rotation on the shaft. The at least two bridging supports each include a shaft-mounting portion, and first and second end portions extending from the shaft-mounting portion and configured to abut a corresponding one of the first and second housing mount abutment flanges. The first and second end portions each define a first wedge face. First and second wedge members are attachable to the first and second housing mounts, between the abutment flange and the plurality of spaced-apart seats. The first wedge member defines a second wedge face that slidably engages the first wedge faces of the first end portions of each of the at least two bridging supports. The second wedge member defines a second wedge face that slidably engages the first wedge faces of the second end portions of each of the at least two bridging supports.

In an embodiment the cutter ring assembly includes three spaced-apart bridging supports and two cutter rings mounted for rotation on the shaft.

In an embodiment the at least one cutter ring is configured to rotate about an axis that is parallel to the first and second housing mounts.

In an embodiment the first wedge member adjustably attaches to the first housing mount, and is configured to clamp the first end portions of the at least two bridging supports against the abutment flange of the first housing mount to produce a controllable clamping force on the first end portions.

In an embodiment the first and second wedge members further include an inner portion defining a leverage arm and at least one flange.

In an embodiment the inner portion of the first and second wedge members includes a pair of flanges.

In an embodiment the abutment flanges of the first and second housing mounts have at least one notch configured to accommodate the at least one cutter ring.

In an embodiment the first wedge member is an elongate member that extends from a first side of the first housing mount to an opposite side of the first housing mount.

In an embodiment the first and second housing mounts each further include a transverse channel in the plate portion adjacent to the plurality of spaced-apart seats and a removable wedge seat that slides into the channel and abuts the plurality of spaced-apart seats. The removable wedge seats each abut a corresponding seating surface of the first and second wedge members.

In an embodiment the first and second housing mounts define channels extending from a back end of the first and second housing mounts and configured to engage the bridging supports and the cutter ring(s) such that the cutter ring assembly is slidable along a straight path from a back end of the housing mounts to a position wherein the first and second end members of the bridging supports abut the abutment flange of the first and second housing mounts.

A cutter ring assembly for a tunnel boring machine having first and second housing mounts fixed to the tunnel boring machine, each housing mount having a plate portion, an abutment flange, and a plurality of spaced-apart seats, the cutter ring assembly having at least two spaced-apart bridging supports, a shaft supported by the at least two bridging supports, and at least one cutter ring mounted for rotation on the shaft. The at least two bridging supports each having a shaft-mounting portion, a first end portion extending from the shaft-mounting portion and configured to abut a first housing mount abutment flange and a second end portion extending from the shaft-mounting portion and configured to abut the second housing mount abutment flange. The first and second end portions each define a first wedge face. A first wedge member is attachable to the first housing mount between the abutment flange and the plurality of spaced-apart seats, the first wedge member defining a second wedge face that slidably engages the first wedge faces of the first end portions of each of the at least two bridging supports. A second wedge member is attachable to the second housing mount between the abutment flange and the plurality of spaced-apart seats, the second wedge member defining a second wedge face that slidably engages the first wedge faces of the second end portions of each of the at least two bridging supports.

In an embodiment the cutter ring assembly comprises three spaced-apart bridging supports and two cutter rings mounted for rotation on the shaft.

In an embodiment the at least one cutter ring is configured to rotate about an axis that is parallel to the first and second housing mounts.

In an embodiment the first wedge member is adjustably attachable to the first housing mount, wherein the first wedge member is configured to clamp the first end portions of the at least two bridging supports against the abutment flange of the first housing mount to produce a controllable clamping force on the first end portions.

In an embodiment the first and second wedge members further comprise an inner portion defining a leverage arm and at least one flange.

In an embodiment the inner portion of the first and second wedge members further comprises a pair of flanges.

In an embodiment the first wedge member is an elongate member that extends from a first side of the first side of the first housing mount to an opposite side of the first housing mount.

A cutter ring assembly for a tunnel boring machine having a first housing mount and a second housing mount, each housing mount having a plate portion, an abutment flange, and a plurality of spaced-apart seats; the cutter ring assembly includes at least two spaced-apart bridging supports, a shaft supported by the at least two bridging supports, and at least one cutter ring mounted for rotation on the shaft. The at least two bridging supports each comprise a shaft-mounting portion, a first end portion extending from the shaft-mounting portion and configured to abut a first housing mount abutment flange and a second end portion extending from the shaft-mounting portion and configured to abut the second housing mount abutment flange, wherein the first and second end portions each define a first wedge face.

In an embodiment the cutter ring assembly comprises three spaced-apart bridging supports and two cutter rings mounted for rotation on the shaft.

In an embodiment the at least one cutter ring is configured to rotate about an axis that is parallel to the first and second housing mounts.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

The rotating main cutter head for a tunnel boring machine will typically have a number of cutter assemblies mounted to the cutter head and positioned to engage the strata, rock and/or soil to be bored. The number and placement of cutter assemblies will vary between tunnel boring machines, for example, depending on the size of the cutter head and the characteristics of the material that will be encountered by the tunnel boring machine. The cutter head may also have other devices to facilitate tunnel boring, for example non-rotating spikes or the like.

Figure 2:
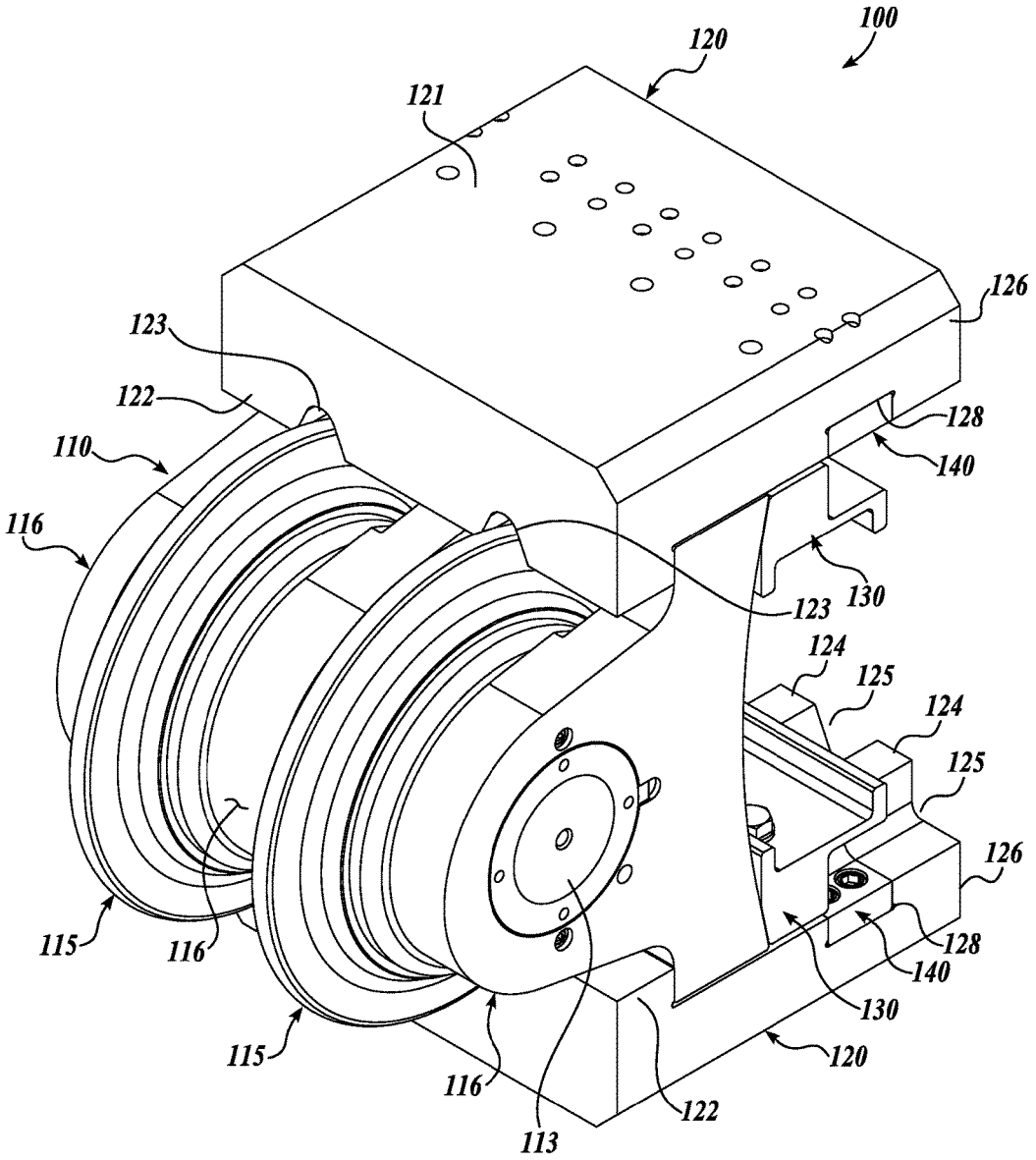
FIG. 2 is a perspective view of a cutter assembly in accordance with the present invention, and having twin cutter ring assemblies that are configured for inline mounting to oppositely disposed housing mounts.
Figure 3:
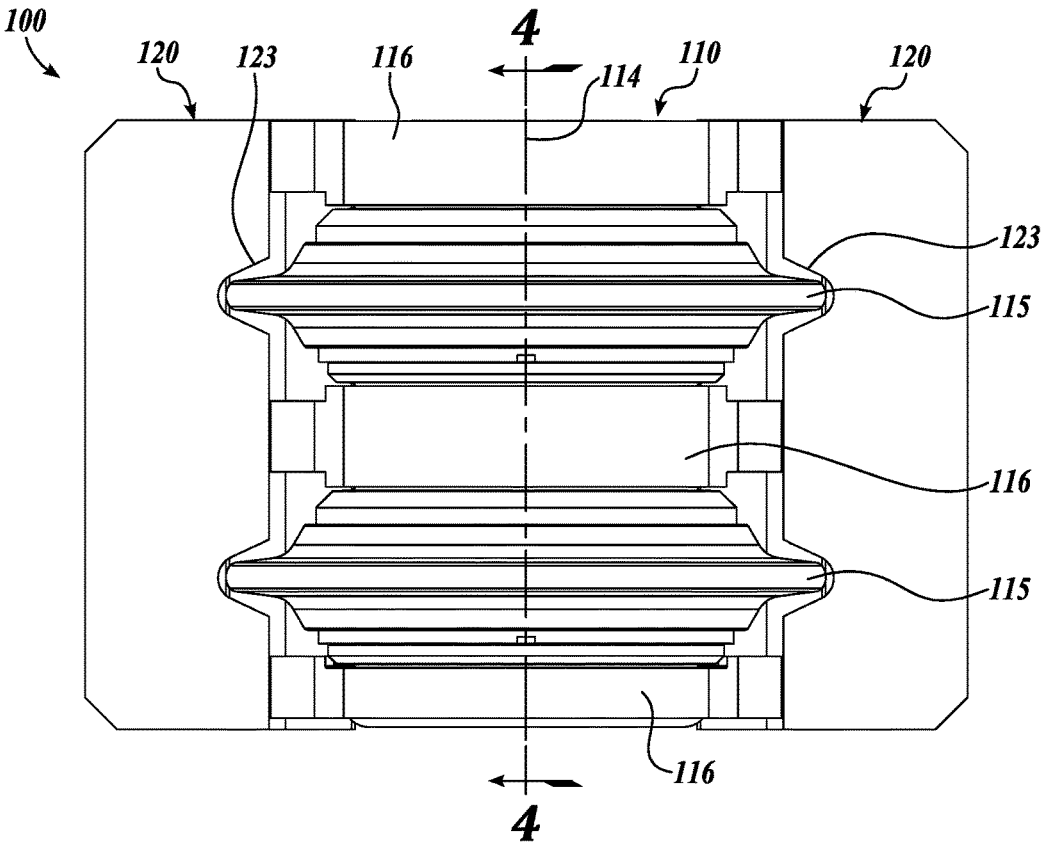
FIG. 3 is a front view of the cutter assembly shown in FIG. 2.

A cutter assembly 100 (including mounting components) in accordance with the present invention is shown in a perspective view in FIG. 2. A front view of the cutter assembly 100 is shown in FIG. 3. The cutter assembly 100 includes oppositely disposed housing mounts 120 and a cutter ring assembly 110, which in this embodiment includes two cutter rings 115 rotatably mounted between the housing mounts 120 on three bridging supports 116. Typically the housing mounts 120 are semi-permanently fixed to corresponding mounting plates (not shown) on the main cutter head of a tunnel boring machine, for example, by welding the housing mounts to the corresponding mounting plates.

Figure 1:
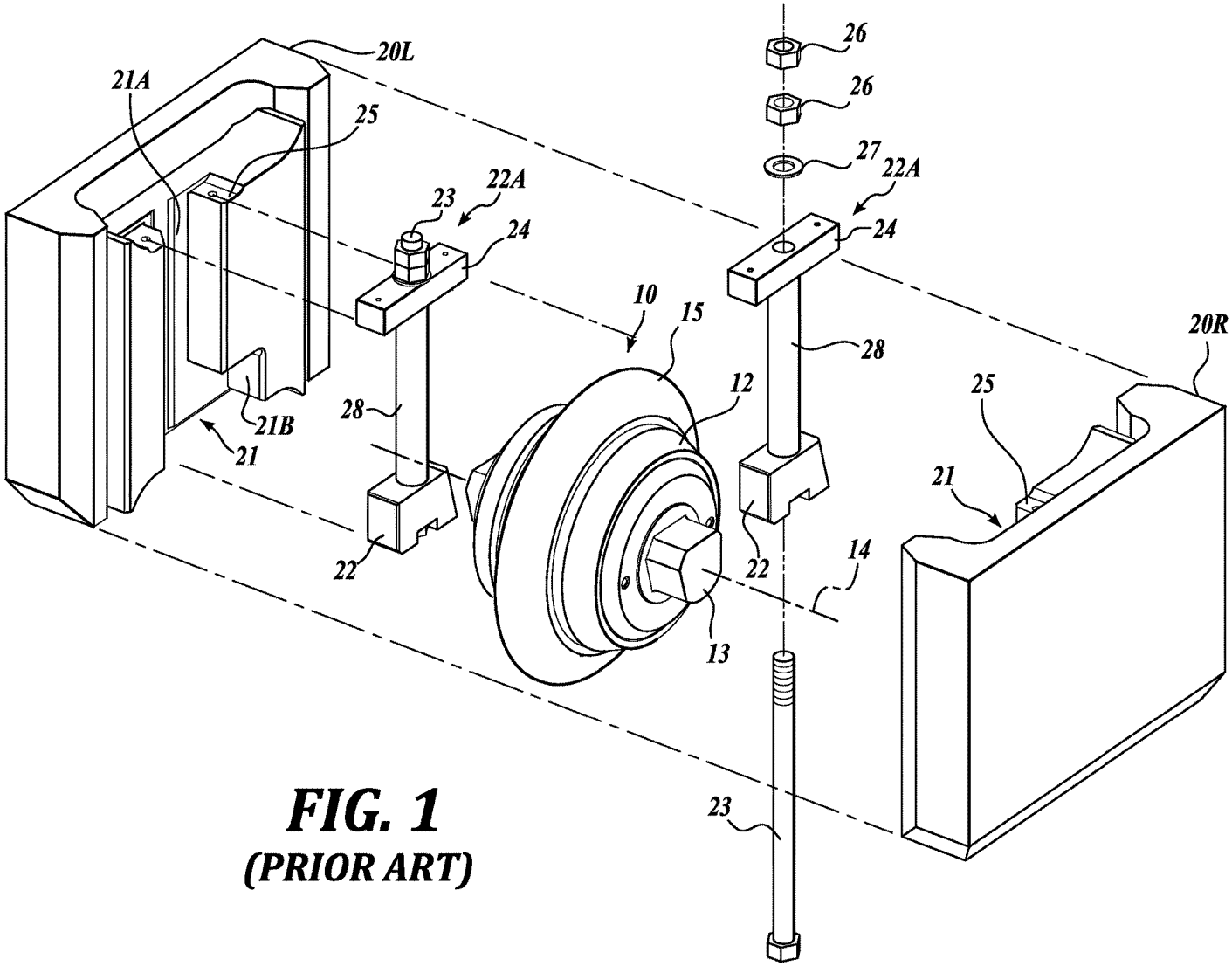
FIG. 1 (PRIOR ART)
FIG. 1 is a perspective, partially exploded view of a prior art cutter assembly and mounting system.

A pair of elongate wedge members 130 secures the bridging supports 116 to an associated one of the housing mounts 120. Although two cutter rings 115 are shown, it will be appreciated by persons of skill in the art that cutter assemblies in accordance with the present invention may include one, or more than two, cutter rings 115. In prior art cutter assemblies, for example the cutter assembly shown in FIG. 1, the shaft 13 (and axis of rotation of the cutter ring) is disposed generally perpendicular to the housing mounts 20L, 20R. The shaft 113 in the cutter assembly 100 shown in FIG. 2 is parallel to the housing mounts 120 and in a center-plane between the housing mounts 120. The cutter rings 115 therefore are mounted to rotate about an axis 114 parallel to, and in a center-plane between, the housing mounts 120.

Figure 6A:
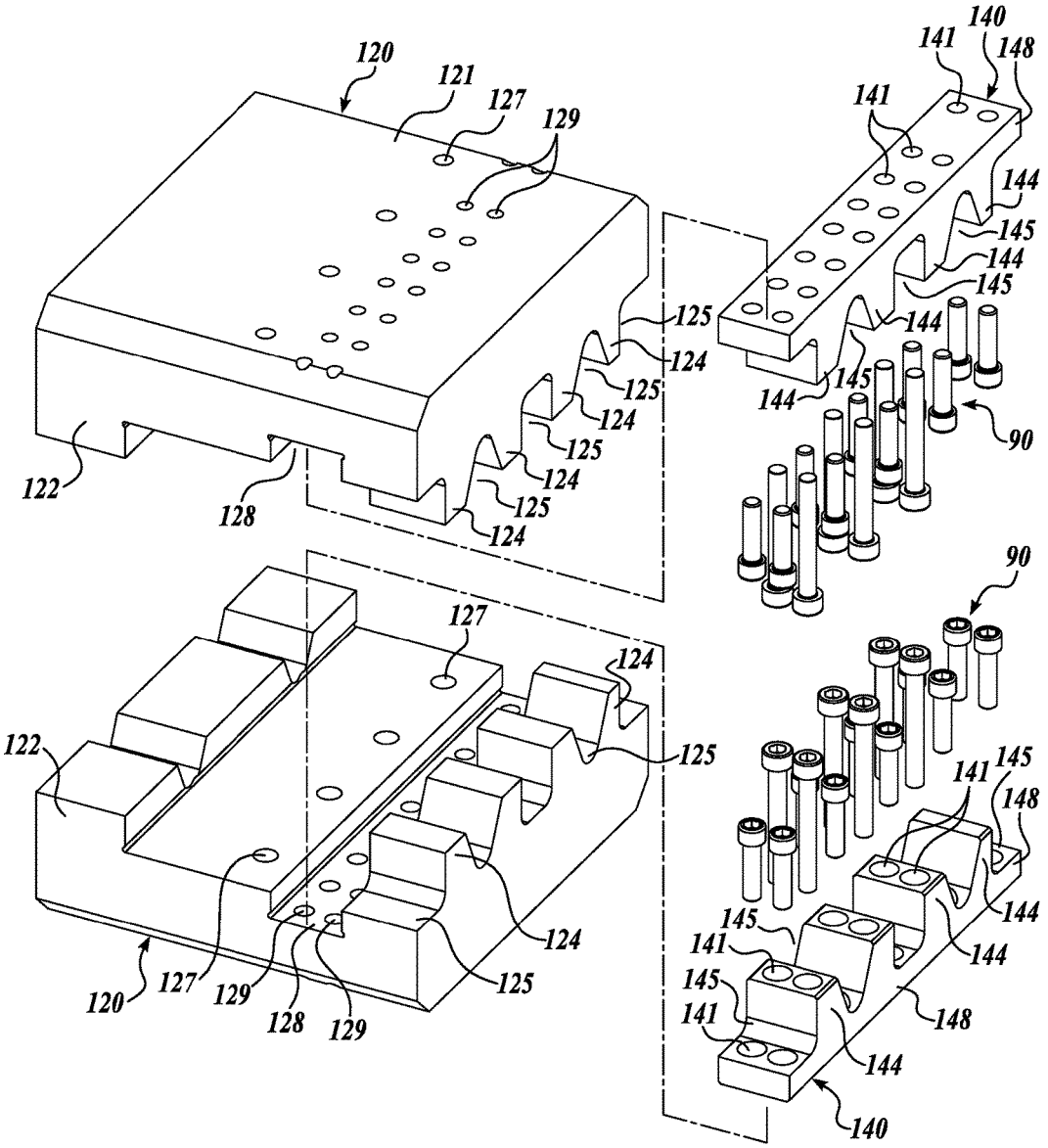
FIGS. 6A-6D illustrate an assembly sequence for the cutter assembly shown in FIG. 2.

Each of the housing mounts 120 includes a plate portion 121 fixable to the main cutter head of a tunnel boring machine, a forward abutment flange 122 extending from the plate portion 121, and a rearward portion 126 having spaced-apart integral seat portions 124 defining channels 125 between the integral seat portions 124 (see also, FIG. 6A). The abutment flanges 122 may optionally include one or more notches 123 sized and positioned to accommodate a radially outer portion of respective cutter ring 115. In this embodiment, field-replaceable wedge seats 140 are removably attached to the plate portions 121, providing a replaceable seating structure for the associated elongate wedge member 130. A transverse channel 128 in each of the housing mounts 120 is configured to receive the corresponding removable wedge seats 140. Alternatively wedge seats may be formed integrally with the corresponding housing mount, for example by extending the integral seat portions 124.

Figure 4:
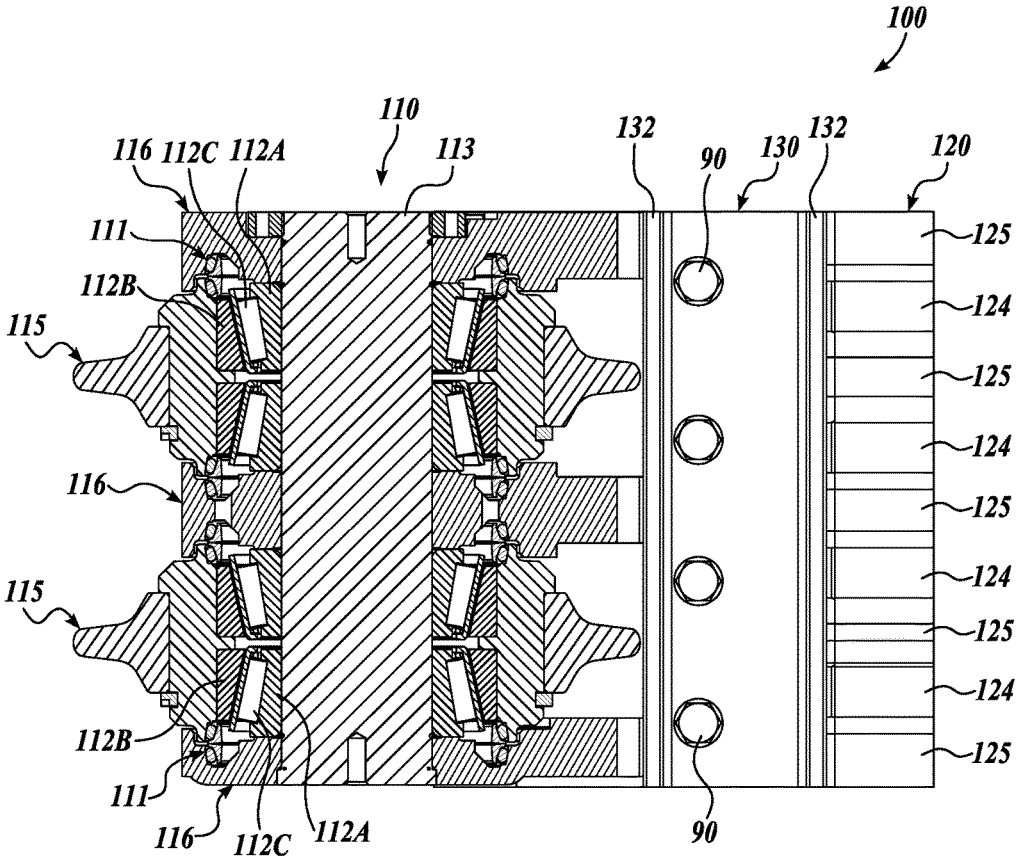
FIG. 4 is a sectional side view of the cutter assembly shown in FIG. 2, through section 4-4 indicated in FIG. 3.

Refer now also to FIG. 4, which shows a sectional view of the cutter assembly 100 through section 4-4 indicated on FIG. 3. The cutter ring assembly 110 includes a shaft 113 that is fixedly supported by the bridging supports 116. In this embodiment a single shaft 113 engages the end bridging supports 116 and extends through the middle bridging support 116. In other embodiments the shaft may comprise two or more separable portions. Each of the cutter rings 115 are rotatably mounted on the shaft 113 with a pair of bearing assemblies, each bearing assembly having inner bearing races 112A that engage the shaft 113, outer bearing races 112B that engage the cutter rings 115, and a plurality of tapered roller bearings 112C. Rotary seal groups 111 are also shown. The rotary seal groups 111 may be, for example, mechanical face seals.

Figure 5:
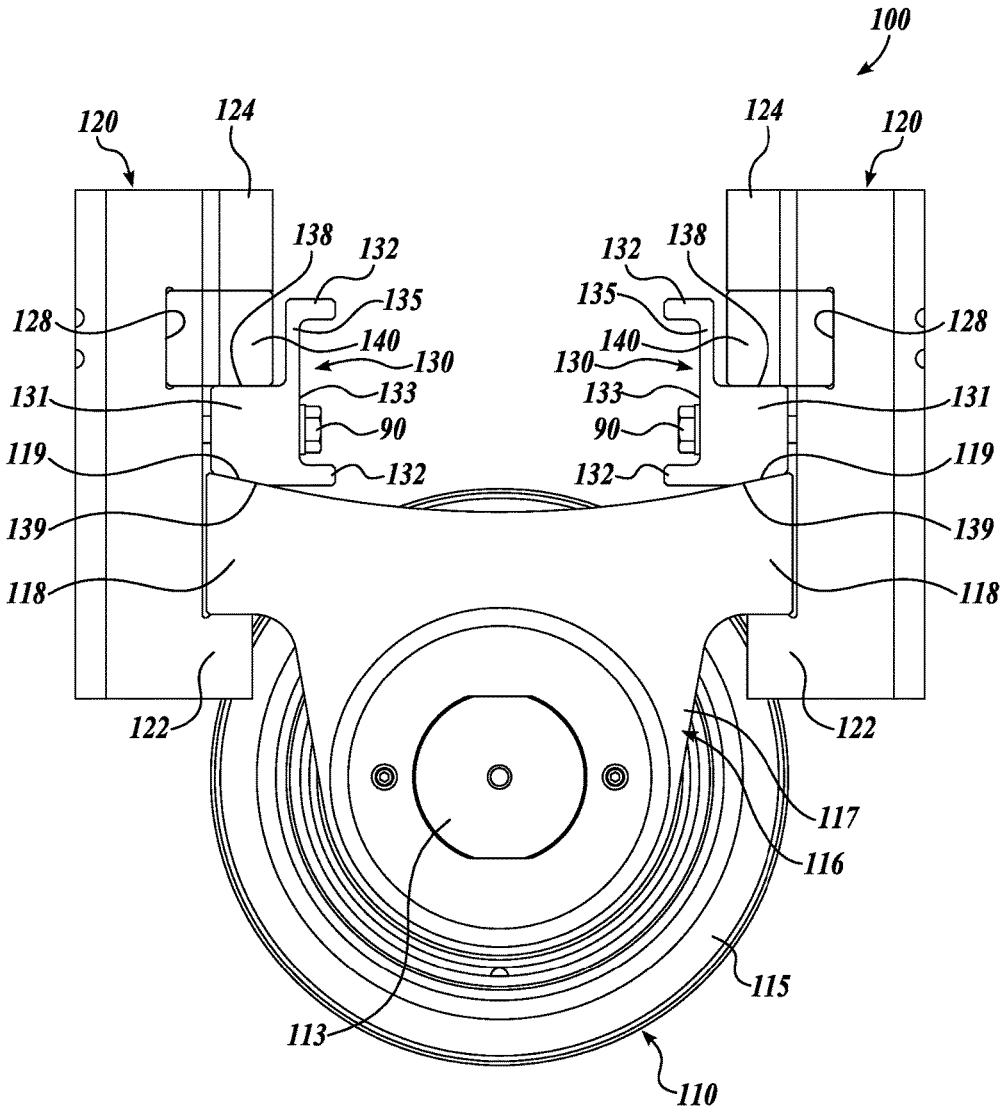
FIG. 5 is a plan view of the cutter assembly shown in FIG. 2.

Refer now also to FIG. 5, which shows a plan view of the cutter assembly 100. The bridging supports 116 are generally T-shaped with a cutter ring mounting portion 117 that extends between and away from the housing mounts 120, and wedge-shaped end portions 118 that abut the corresponding abutment flange 122 of the housing mounts 120. The wedge-shaped end portions 118 of the bridging supports 116 define first wedge faces 119.

The elongate wedge members 130 are each removably attached to a corresponding one of the housing mounts 120 with bolts 90. Referring still to FIG. 5, each wedge member 130 has a wedge portion 131, disposed between the associated removable seat 140 and the bridging support end portions 118 on the same side, and an inner portion 133. The wedge portion 131 defines a seating surface 138 that abuts the removable wedge seat 140, and a second wedge face 139. The second wedge face 139 is configured to slidably engage the first wedge faces 119 of the associated end portions 118 of each of the bridging supports 116. In this embodiment the inner portion 133 extends inwardly from the wedge portion 131 and the associated housing mount 120, and further includes spaced-apart flanges 132. The inner portion 133 of each wedge member 130 significantly improves the elastic section modulus properties of the wedge member 130. The inner portions 133 in this embodiment include an extension arm 135 that extends rearwardly and may facilitate removal of the wedge member 130 (for example to service the assembly 100 in the field) by providing the user with a leverage arm during removal to assist in prying the wedge member 130 away from the housing mount 120 after the bolts 90 have been removed.

Each elongate wedge portion 131 extends between and slidably engages the corresponding removable seat 140 and the bridging support end portions 118. It will be appreciated that the first wedge faces 119 of the end portions 118 and the second wedge face 139 of the wedge portion 131 are configured to slidably engage, such that urging the wedge member 130 towards the corresponding housing mount 120 (with attachment bolts 90) will produce clamping forces on the bridging support end portions 118. The wedge portion 131 is sized and configured such that very large clamping forces may be produced on the end portions 118 as the bolts 90 are tightened, resulting in a large preload on the wedge-shaped end portion 118. Moreover, the magnitude of preload may be designed into the wedge members 130. For example, a larger preload may be achieved for a given bolt tension by providing a smaller wedge angle.

Preloading the end portions 118 of the bridging supports 116 provides structural advantages during tunnel boring operations. In particular, the cutter rings 115 are pressed with great force against the rock face (or other strata), and as the main cutter head rotates large time-varying forces are produced that must be reacted through the cutter assembly 100. In particular, the large forces have a load path from the cutter ring 115, to the shaft 113, to the bridging supports 116, to the wedge member 130, and then to the housing mounts 120 (through the removable wedge seat 140). These large forces urge the bridging support end portions 118 away from abutment with the housing mounts abutment flanges 122. It is important that the bridging supports end portions 118 remain securely clamped between the abutment flange 122 and the wedge member 130 during tunnel boring, such that the end portions 118 do not move away from the abutment flange 122. In the cutter ring assembly 110 the wedge members 130 urge the end portions 118 in the direction directly opposed to the external boring forces. Preloading the end portions 118 towards the abutment flange 122 resists undesired motion of the cutter ring assembly 110 in the housing mounts 120.

Refer now to FIGS. 6A-6D, which illustrate the method for assembling the housing mount assemblies and installing the cutter ring assembly 110 into the housing mounts 120. Referring first to FIG. 6A, the removable seats 140 in this embodiment are elongate members having a base portion 148 sized and shaped to slidably engage the transverse channel 128 of the corresponding housing mount 120. A plurality of spaced-apart seat portions 144 extend from the base portion 148, defining a plurality of channels 145 between the seat portions 144, and including channels 145 outboard of the seat portions 144. As seen most clearly in FIG. 6B, the seat portions 144 and channels 145 are configured to abut and extend the corresponding integral seat portions 124 and channels 125 in the corresponding housing mount 120 when the removable wedge seat 140 is installed in the housing mount 120.

It will be appreciated that a unique aspect of the cutter assembly 100 is the channels 125 that are located to accommodate the cutter ring assembly 110 (cutter rings 115 and bridging supports 116) and, if the removable seat members 140 are used, the corresponding channels 145 in the removable seat members 140. These channels 125, 145 allow the cutter ring assembly 110 to be installed (and removed) inline. The cutter ring assembly 110 is installed by sliding the cutter ring assembly 110 along a straight path from the back end of the housing mounts 120 forward until the bridging supports 116 abut the forward abutment flanges 122 of the housing mounts 120, and then installing the elongate wedge members 130 to each housing mount 120. For example, the bolts 90 may be tightened to a predetermined torque to produce a desired clamping force on the associated end portions 118.

Therefore, to install the cutter ring assembly 110 in pre-installed housing mounts 120, the removable wedge seats 140 (if included) are positioned in transverse channels 128 in the corresponding housing mounts 120, aligning stepped through-holes 141 in the seats 140 with threaded holes 129 in the channel 128. The wedge seats 140 are fixed to the housing mount 120 with bolts 90. As discussed above, the removable wedge seats 140 allow the cutter assemblies 100 to be serviced in the field without requiring removal of the housing mounts 120 from the main cutter head.

Figure 6B:
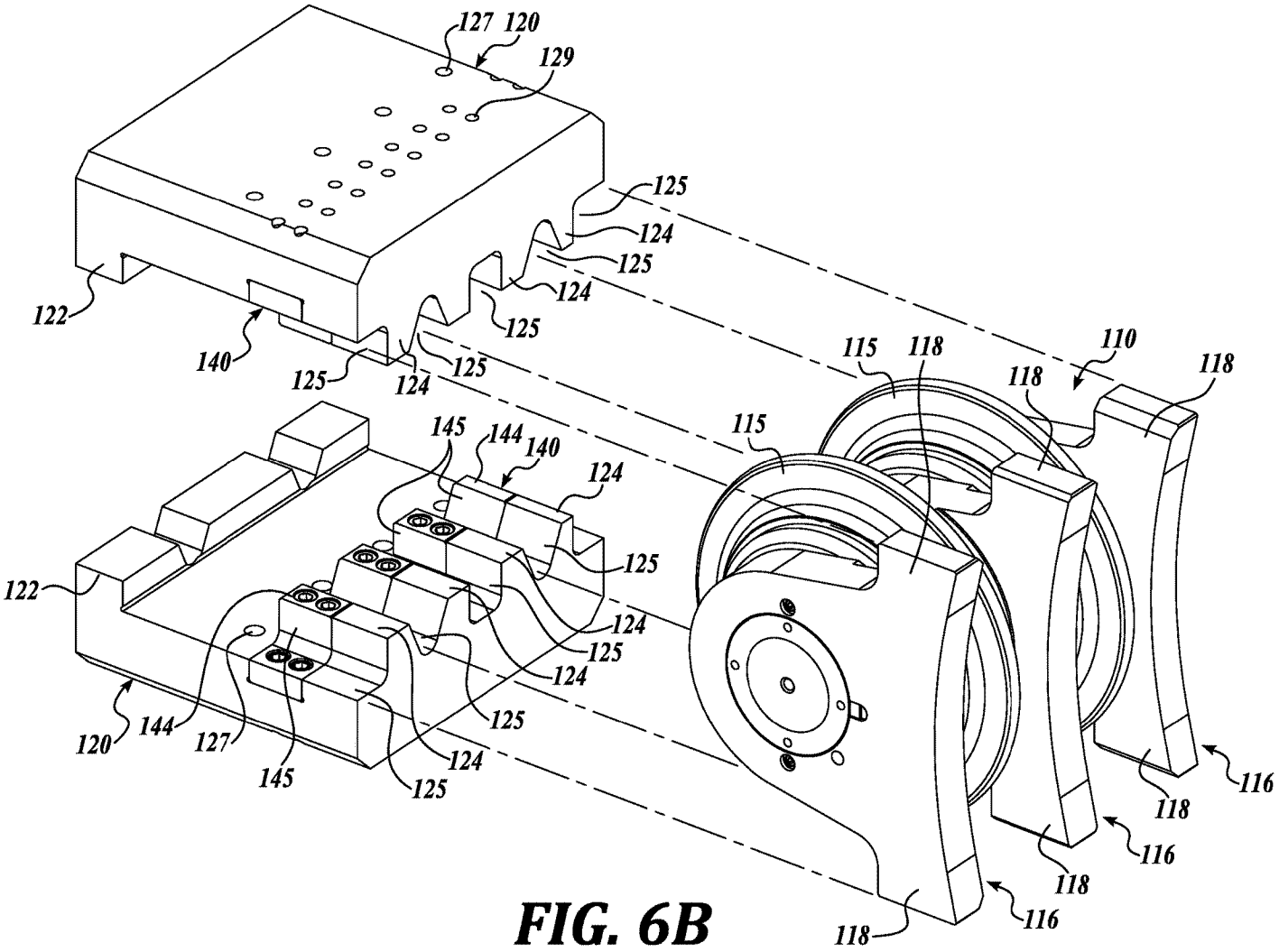
Figure 6C:
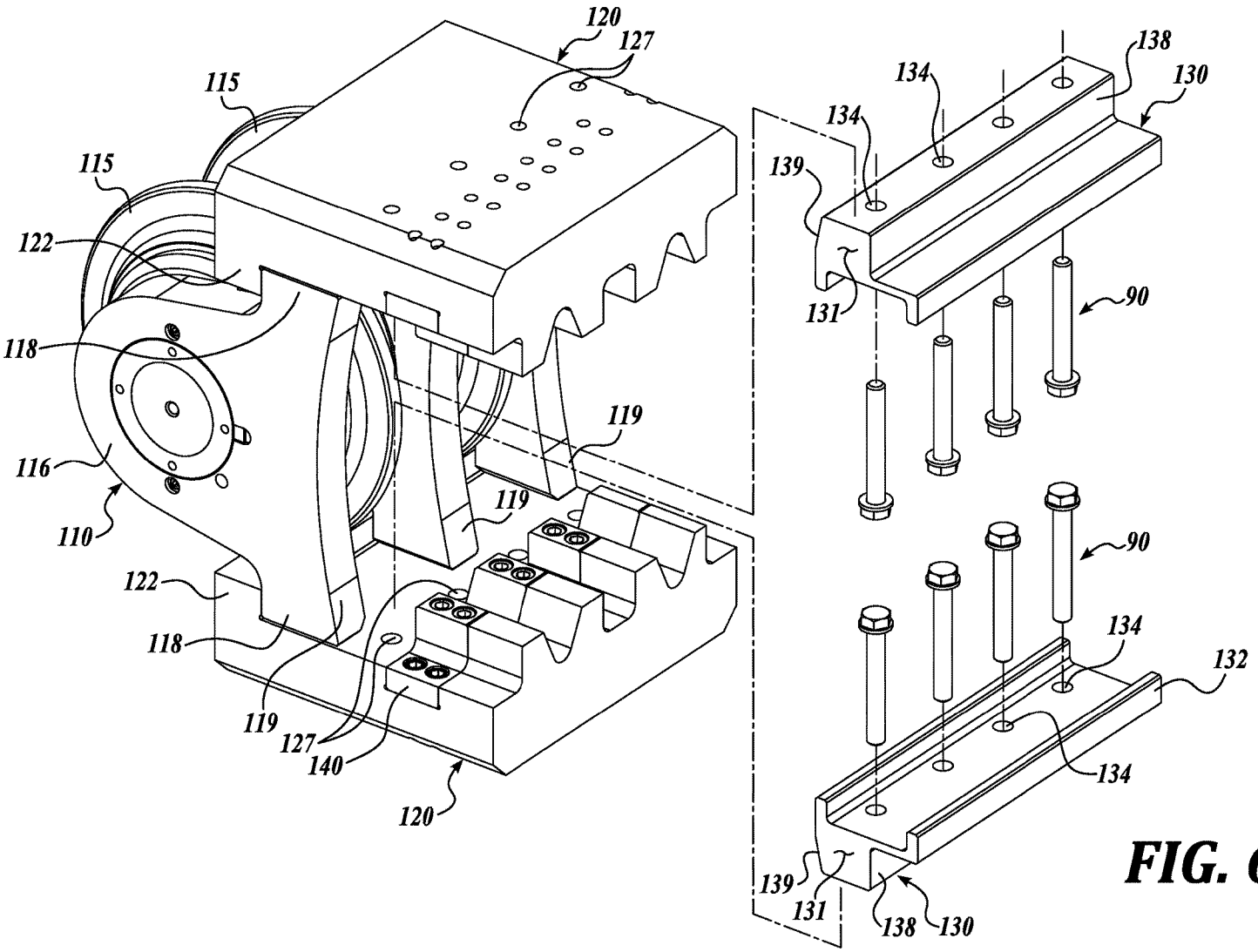

As illustrated in FIG. 6B, the cutter ring assembly 110 is then inserted between the housing mounts 120, such that the cutter rings 115 and bridging supports 116 slidably engage corresponding channels 125. The cutter ring assembly 110 is inserted until the end portions 118 of the bridging supports 116 abut the forward abutment flange 122 of the housing mounts 120 (FIG. 6C).

The elongate wedge members 130 are then installed by inserting the wedge portions 131 between the corresponding removable wedge seat 140 and bridging support end portions 118, aligning apertures 134 on each wedge member 130 with corresponding threaded apertures 127 in the housing mounts 120, such that the second wedge face 139 engages the first wedge faces 119 on the corresponding end portions 118 of the bridging supports 116, and the seating surface 138 engages the removable wedge seat 140. The wedge members 130 are then attached to the housing mount 120 with bolts 90 which are tightened to a predetermined torque, to produce a desired preloading of the end portions 118 against the abutment flange 122.

Figure 6D:
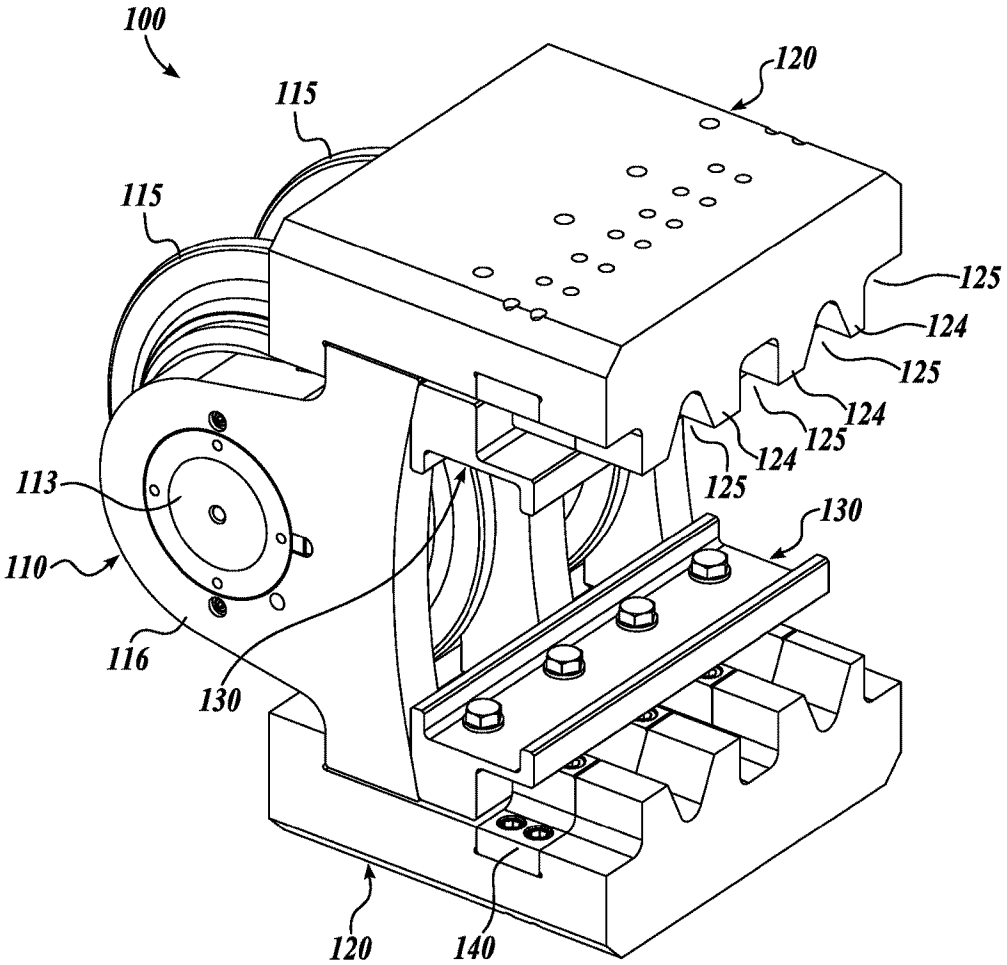

As shown in FIG. 6D, the cutter assembly 100 is relatively compact in size, because the cutter ring assembly 110 is installed without requiring a lateral shift commonly required in prior art mounting systems. The inline mounting is particularly advantageous in tunnel boring machines because it simplifies the installation and removal of the cutter ring assemblies, and allows more cutter ring assemblies to be fit onto a main cutter head of a given size. It will further be appreciated that cutter ring assemblies for tunnel boring machines are relatively massive components, and it is therefore not a simple task to laterally shift the position of the cutter ring assembly, particularly in the field. The inline mounting of the cutter ring assembly 110 of the present invention allows the cutter ring assembly 110 to be installed and removed with only an inline movement of the assembly 110 through the housing mounts 120. Moreover, the positioning and guiding of the cutter ring assembly 110 during installation and removal is facilitated by the channels 125, 145 that accommodate and engage the cutter rings 115 and the bridging supports 116.

While illustrative embodiments have been illustrated and described, it will be appreciated that various changes can be made therein without departing from the spirit and scope of the invention.

The invention claimed is:

1. A cutter assembly for a tunnel boring machine comprising:

a first housing mount and a second housing mount, the first and second housing mounts being configured to be fixed to the tunnel boring machine, each housing mount having a plate portion, an abutment flange, and a plurality of spaced-apart seats;

a cutter ring assembly comprising at least two spaced-apart bridging supports, a shaft supported by the at least two bridging supports, and at least one cutter ring mounted for rotation on the shaft, wherein the at least two bridging supports each comprise a shaft-mounting portion, a first end portion extending from the shaft-mounting portion and configured to abut the first housing mount abutment flange and a second end portion extending from the shaft-mounting portion and configured to abut the second housing mount abutment flange, wherein the first and second end portions each define a first wedge face;

a first wedge member attachable to the first housing mount between the abutment flange and the plurality of spaced-apart seats, the first wedge member defining a second wedge face that slidably engages the first wedge faces of the first end portions of each of the at least two bridging supports; and a second wedge member attachable to the second housing mount between the abutment flange and the plurality of spaced-apart seats, the second wedge member defining a second wedge face that slidably engages the first wedge faces of the second end portions of each of the at least two bridging supports.

2. The cutter assembly of claim 1, wherein the cutter ring assembly comprises three spaced-apart bridging supports and two cutter rings mounted for rotation on the shaft.

3. The cutter assembly of claim 1, wherein the at least one cutter ring is configured to rotate about an axis that is parallel to the first and second housing mounts.

4. The cutter assembly of claim 1, wherein the first wedge member is adjustably attachable to the first housing mount, wherein the first wedge member is configured to clamp the first end portions of the at least two bridging supports against the abutment flange of the first housing mount to produce a controllable clamping force on the first end portions.

5. The cutter assembly of claim 1, wherein the first and second wedge members further comprise an inner portion defining a leverage arm and at least one flange.

6. The cutter ring assembly of claim 5, wherein the inner portion of the first and second wedge members further comprises a pair of flanges.

7. The cutter assembly of claim 1, wherein the abutment flanges of the first and second housing mounts further comprise at least one notch configured to accommodate the at least one cutter ring.

8. The cutter assembly of claim 1, wherein the first wedge member is an elongate member that extends from a first side of the first housing mount to an opposite side of the first housing mount.

9. The cutter assembly of claim 1, wherein the first and second housing mounts each further comprises a transverse channel in the plate portion adjacent to the plurality of spaced-apart seats and a removable wedge seat configured to slidably engage the channel and abut the plurality of spaced-apart seats, wherein the removable wedge seats each abut a corresponding seating surface of the first and second wedge members.

10. The cutter assembly of claim 1, wherein the first and second housing mounts define a plurality of channels extending from a back end of the first and second housing mounts and configured to slidably engage the at least two bridging supports and the at least one cutter ring such that the cutter ring assembly is slidable along a straight path from a back end of the housing mounts to a position wherein the first and second end members of the bridging supports abut the abutment flange of the first and second housing mounts.

11. A cutter ring assembly for mounting to a first housing mount and a second housing mount on a tunnel boring machine, each housing mount having a plate portion, an abutment flange, and a plurality of spaced-apart seats, the cutter ring assembly comprising;

at least two spaced-apart bridging supports;

a shaft supported by the at least two bridging supports; and at least one cutter ring mounted for rotation on the shaft;

wherein the at least two bridging supports each comprise a shaft-mounting portion, a first end portion extending from the shaft-mounting portion and configured to abut a first housing mount abutment flange and a second end portion extending from the shaft-mounting portion and configured to abut the second housing mount abutment flange, wherein the first and second end portions each define a first wedge face;

a first wedge member attachable to the first housing mount between the abutment flange and the plurality of spaced-apart seats, the first wedge member defining a second wedge face that slidably engages the first wedge faces of the first end portions of each of the at least two bridging supports; and a second wedge member attachable to the second housing mount between the abutment flange and the plurality of spaced-apart seats, the second wedge member defining a second wedge face that slidably engages the first wedge faces of the second end portions of each of the at least two bridging supports.

12. The cutter ring assembly of claim 11, wherein the cutter ring assembly comprises three spaced-apart bridging supports and two cutter rings mounted for rotation on the shaft.

13. The cutter ring assembly of claim 11, wherein the at least one cutter ring is configured to rotate about an axis that is parallel to the first and second housing mounts.

14. The cutter ring assembly of claim 11, wherein the first wedge member is adjustably attachable to the first housing mount, wherein the first wedge member is configured to clamp the first end portions of the at least two bridging supports against the abutment flange of the first housing mount to produce a controllable clamping force on the first end portions.

15. The cutter assembly of claim 11, wherein the first and second wedge members further comprise an inner portion defining a leverage arm and at least one flange.

16. The cutter ring assembly of claim 15, wherein the inner portion of the first and second wedge members further comprises a pair of flanges.

17. The cutter assembly of claim 11, wherein the first wedge member is an elongate member that extends from a first side of the first housing mount to an opposite side of the first housing mount.

18. A cutter ring assembly for a tunnel boring machine having a first housing mount and a second housing mount, each housing mount having a plate portion, an abutment flange, and a plurality of spaced-apart seats, the cutter ring assembly comprising;

at least two spaced-apart bridging supports;

a shaft supported by the at least two bridging supports; and at least one cutter ring mounted for rotation on the shaft;

wherein the at least two bridging supports each comprise a shaft-mounting portion, a first end portion extending from the shaft-mounting portion and configured to abut a first housing mount abutment flange and a second end portion extending from the shaft-mounting portion and configured to abut the second housing mount abutment flange, wherein the first and second end portions each define a first wedge face.

19. The cutter ring assembly of claim 18, wherein the cutter ring assembly comprises three spaced-apart bridging supports and two cutter rings mounted for rotation on the shaft.

20. The cutter ring assembly of claim 18, wherein the at least one cutter ring is configured to rotate about an axis that is parallel to the first and second housing mounts.

* * * * *